United States Patent [19]

Nakamura

[11] Patent Number: 4,974,342

[45] Date of Patent: Dec. 4, 1990

[54] INNER SOLE FOR SHOE

[76] Inventor: Toshimitsu Nakamura, No. 496, Takenokoba, Kosaza-cho, Kitamatuura-gun, Nagasaki-ken, Japan

[21] Appl. No.: 373,760

[22] Filed: Jun. 30, 1989

[30] Foreign Application Priority Data

Jul. 6, 1988 [JP] Japan ..... 89566[U]

[51] Int. Cl.[5] ..... A43B 7/06; A43B 13/40

[52] U.S. Cl. ..... 36/3 B; 36/3 R; 36/44

[58] Field of Search ..... 36/3 B, 3 R, 43, 44

[56] References Cited

U.S. PATENT DOCUMENTS

| | | | |
|---|---|---|---|
| 3,142,912 | 8/1964 | Larsen | 36/3 R |
| 3,180,039 | 4/1965 | Burns, Jr. | 36/3 B |
| 3,225,463 | 12/1965 | Burnham | 36/29 |
| 3,475,836 | 11/1969 | Brahm | 36/3 B |
| 3,716,930 | 2/1973 | Brahm | 36/3 B |
| 4,215,492 | 8/1980 | Sandmeier | 36/3 B |
| 4,224,746 | 9/1980 | Kim | 36/3 B |
| 4,776,110 | 10/1988 | Shiang | 36/3 B |

*Primary Examiner*—Steven N. Meyers

*Attorney, Agent, or Firm*—Townsend and Townsend

[57] ABSTRACT

An inner sole for a shoe which has upper and lower foot form sheets bonded through an elastic porous material to the heel of the rear portion thereof and through spaces to the front portion thereof, a suction valve provided in a portion to be bonded to the elastic porous material of the lower foot form sheet, an air feed valve provided at the front of the elastic porous material, and an air discharge hole formed at the front portion of the upper foot form sheet in such a manner that the discharge hole is communicated through an air feed passage, obtained between the spacer, with the valve hole of the suction valve. Thus, a foot is hardly moistened even if the shoe is worn for a long time.

1 Claim, 1 Drawing Sheet

INNER SOLE FOR SHOE

BACKGROUND OF THE INVENTION

The present invention relates to an inner sole for a shoe which can discharge air sucked from the heel of the shoe to the toe of the shoe to hold the interior of the shoe cool.

DESCRIPTION OF THE PRIOR ART

A conventional inner sole for a shoe which is formed by forming a mesh material made of synthetic resin in a foot form shape is known.

The conventional inner sole has an advantage of being relatively comfortable for a while after the shoe is worn, but since the conventional sole has almost no air permeability in the shoe, the temperature and the moisture of the shoe become high while the shoe is worn for a long time, and the feet tend to become moistened.

SUMMARY OF THE INVENTION

Accordingly, an object of the present invention is to provide an inner sole for a shoe in which a foot is hardly moistened even if the shoe is worn for a long time.

In order to achieve the above and other objects, there is provided according to the present invention an inner sole 2 for a shoe comprising upper and lower foot form sheets 3 and 4 bonded through an elastic porous material 5 to the heel of the rear portion thereof and through spacers 6 and 7 to the front portion thereof, a suction valve 13 provided in a portion to be bonded to the elastic porous material 5 of the lower foot form sheet 4, an air feed valve 15 provided at the front of the elastic porous material 5, and an air discharge hole 16 formed at the front portion of the upper foot form sheet 3 in such a manner that the discharge hole 16 is communicated through an air feed passage 8 obtained between the spacers 6 and 7 with the valve hole 13*a* of the suction valve 13.

In the arrangement described above, the inner sole 2 is laid in the shoe 1 and the shoes 1 are employed to walk. Then, each time the heel of the shoe is strongly contacted with the upper foot form sheet 3, the elastic porous material 5 is recovered in its elasticity, the air from the environment is sucked from the suction valve 13 into the elastic porous material 5. Then, when the elastic porous material 5 is again compressed by the heel of the shoe, the air sucked into the shoe is fed out forwardly from the air feed valve 15, and discharged through the air feed passage 8 between the spacers 6 and 7. This operation is repeated to circulate the air in the shoe from the heel to the toe of the shoe, thereby holding the interior of the shoe cool.

Other and further objects, features and advantages of the invention will appear more fully from the following description.

DETAILED DESCRIPTION OF THE PREFERRED EMBODIMENTS

Figure 1:
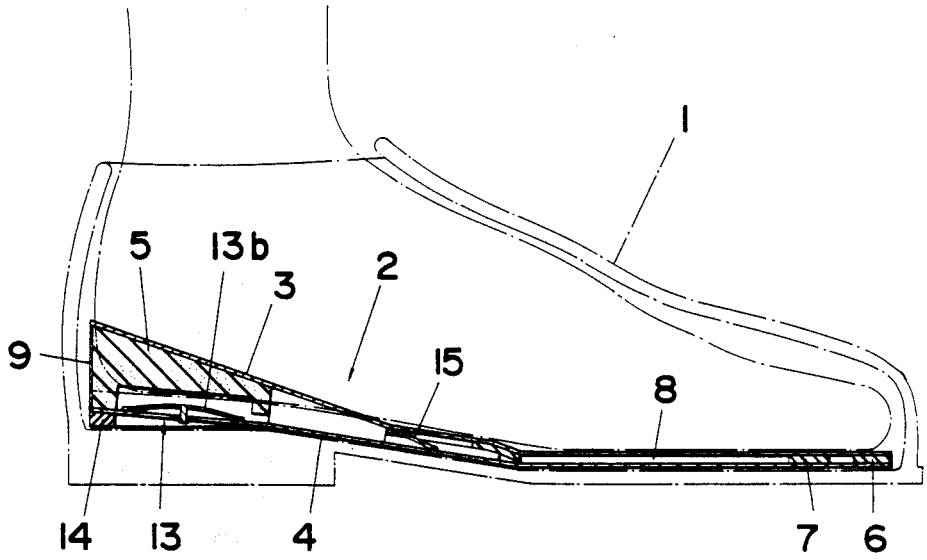
FIG. 1 is a side view showing a shoe with an inner sole according to the present invention.
Figure 2:
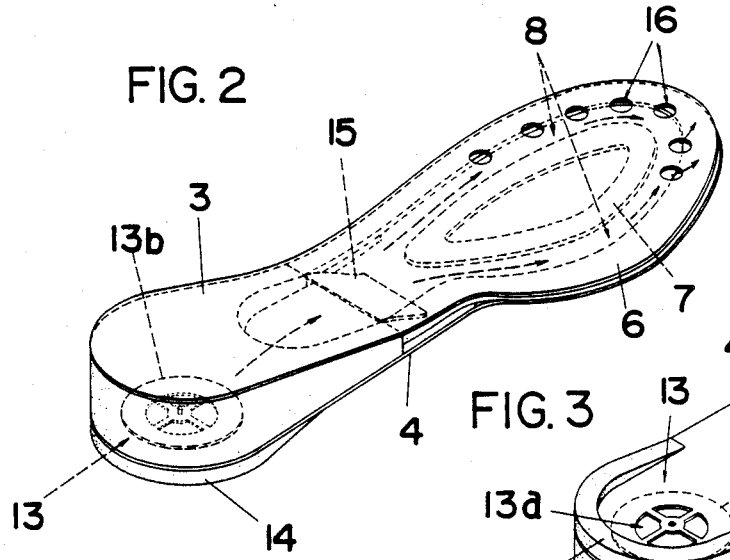
FIG. 2 is a perspective view of the inner sole.
Figure 3:
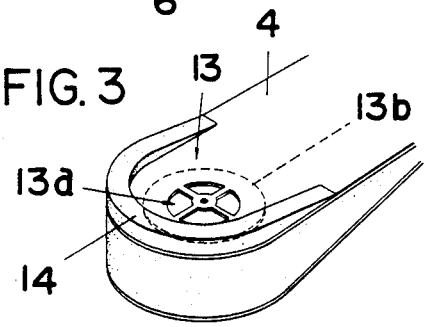
FIG. 3 is a partial perspective view of the inner sole.

The most preferable embodiment of the present invention will be described in detail with reference to the accompanying drawings.

Reference numeral 1 denotes a shoe, and numeral 2 denotes an inner sole laid in the shoe 1. The inner sole 2 is mainly formed of upper and lower foot form sheets 3 and 4 to be bonded through an elastic porous material 5 made of sponge or the like to the heel of rear portion and through spacers 6 and 7 to the front portion. The spacers 6 and 7 are made of an elastic material such as, for example, hard rubber, and formed of an outer edge spacer 6 formed along the edges of the foot form sheets 3 and 4, and an inner closed loop-like spacer 7, and an air feed passage 8 is formed between both the spacers 6 and 7. Sealing means 9 for preventing inner air from externally leaking is provided on the outer surface of the elastic porous material 5, for example, by coating it with rubber paste.

Numeral 13 denotes a suction valve provided in the bonded portion of the lower sheet 4 to the elastic porous material 5, symbol 13*a* denotes a valve hole, and symbol 13*b* denotes a valve body made of an elastic sheet material. Numeral 14 denotes a ground contact mounted on the rare edge of the lower sheet 4, and made of an elastic material, such as sponge or the like to prevent the sheet 4 from snugly contacting the ground at the bottom of the shoe thereby to eliminate the block of the valve hole 13*a*. Numeral 15 denotes a tongue-like air feed valve disposed at the front side of the elastic porous material 5 and made of an elastic material, such as a rubber material. The upper end of the air feed valve 15 is mounted on the lower surface of the upper sheet 3, and the lower end of the air feed valve 15 is of free end to be separably contacted with the lower sheet 4. Numeral 16 denotes a plurality of discharge holes opened along the edge of the front portion of the upper sheet 3 in communication with the valve hole 13*a* through the air feed passage 8.

The inner sole 2 is constructed as described above. When the inner soles 2 are laid in the shoes 2 and the shoes 2 are employed to walk, the elastic porous material 5 is compressed each time the heel of the shoe 2 is strongly contacted to the upper foot form sheet 3, the elastic porous material 5 is recovered in its elasticity when the heel is floated, and air from the environment is intaken from the suction valve 13 into the elastic porous material 5. Then, when the elastic porous material 5 is again compressed by the heal of the shoe 2, the air sucked therein is discharged from the air feed valve 15 forwardly, and discharged from the discharge holes 16 of the toe through the air feed passage 8 between the spacers 6 and 7.

The above-described operation is repeated, the air in the shoe is circulated from the heel to the toe, thereby holding the temperature and the moisture in the shoe cool.

The present invention can be altered variously in design. For example, the upper foot form sheet may be formed of a porous material. Thus, since the porous material operates also as the function of the air discharge holes, the discharge holes may not be particularly formed. When the inner sole is employed for a long shoe in addition to the shoe, the advantages of the inner sole can be further performed.

In the inner sole for the shoe constructed as described above, the present invention provides the inner sole 2 for a shoe comprising upper and lower foot form sheets 3 and 4 bonded through an elastic porous material 5 to the heel of the rear portion thereof and through spacers 6 and 7 to the front portion thereof, a suction valve 13 provided in a portion to be bonded to the elastic porous material 5 of the lower foot form sheet 4, an air feed valve 15 provided at the front of the elastic porous material 5, and an air discharge hole 16 formed at the front portion of the upper foot form sheet 3 in such a manner that the discharge hole 16 is communicated through an air feed passage 8 obtained between the spacer 6 and 7 with the valve hole 13*a* of the suction valve 13. Thus, each time the shoes 1 are employed to walk, the air is fed from the heel to the toe of the shoe and discharged from the discharge hole 16. Therefore, the air in the shoe is accelerated to be circulated to hole the temperature and the moisture in the shoe cool.

What is claimed is:

1. An inner sole having a heel and front portion for a shoe comprising:

an upper and a lower foot form sheet bonded through an elastic porous material at the heel portion thereof and through spacers at the front portion thereof;

a suction valve provided in a portion of the lower foot form sheet and coupled to the elastic porous material;

an air feed valve disposed between the elastic porous material and the front portion of said inner sole;

an air discharge hole formed at the front portion of the upper foot form sheet wherein the discharge hole is in fluid communication with an air feed passage obtained between the spacers and the suction valve; and a ground contact attached to the lower form sheet at the heel portion wherein a space is created between said lower form sheet and a sole allowing the suction valve to remain unblocked.

* * * * *